US012246211B2

(12) United States Patent
Vaudreuil

(10) Patent No.: US 12,246,211 B2
(45) Date of Patent: Mar. 11, 2025

(54) FREE WEIGHT HARNESS SYSTEM

(71) Applicant: Michael P. Vaudreuil, Vernon, CT (US)

(72) Inventor: Michael P. Vaudreuil, Vernon, CT (US)

( * ) Notice: Subject to any disclaimer, the term of this patent is extended or adjusted under 35 U.S.C. 154(b) by 76 days.

(21) Appl. No.: 17/697,111

(22) Filed: Mar. 17, 2022

(65) Prior Publication Data

US 2022/0296954 A1 Sep. 22, 2022

Related U.S. Application Data

(60) Provisional application No. 63/162,813, filed on Mar. 18, 2021.

(51) Int. Cl.
*A63B 21/078* (2006.01)
*A63B 21/072* (2006.01)

(52) U.S. Cl.
CPC ..... *A63B 21/0783* (2015.10); *A63B 21/0726* (2013.01); *A63B 2225/09* (2013.01)

(58) Field of Classification Search
CPC ..... A63B 21/0783; A63B 21/0726; A63B 2225/09; A63B 71/0036; A63B 17/02; A63B 71/0054; A63B 21/072–075; A63B 21/078–08; A63B 21/0724; A63B 2023/0411; A63B 21/0626; A63B 21/4029; A63B 23/1218; A63B 21/06; A63B 21/0628; A63B 2210/50; A63B 23/03558; A63B 17/00; A63B 21/0615; A63B 21/062; A63B 21/4047; A63B 2225/10;

(Continued)

(56) References Cited

U.S. PATENT DOCUMENTS 5,466,204 A * 11/1995 Nearing ..... A63B 21/16 482/99
6,379,287 B1 * 4/2002 Slawinski ..... A63B 21/0783 482/4

(Continued)

OTHER PUBLICATIONS

Civil Tutorials document (derived from: Er Aashi Muchhoriya, "What is beam | Types of beams | Application, Definition of beam" [online], Feb. 8, 2021 [retrieved on May 4, 2024], Civil Tutorials, Retrieved from: https://civiltutorials.com/types-of-beams/) (Year: 2021).*

*Primary Examiner* — Joshua Lee
*Assistant Examiner* — Catrina A Letterman
(74) *Attorney, Agent, or Firm* — Armis IP Law, LLC

(57) ABSTRACT

A support assembly and exercise system provides safe and unconstrained movement of free weights within a movement zone encompassing normal travel of the free weights during exercise. The system allows safe user engagement and disengagement with the free weights while continually tethered against uncontrolled and possibly harmful movement. The support assembly is defined by a generally free-standing frame with rigid uprights for supporting takeoff and landing zones for the free weights, as well as tether attachments for movably supporting the free weights through the movement zone. A support member has a pivotal attachment to the upright frame for suspending the free weights against an uncontrolled release or fall. Launch and landing platforms attach to the upright frame for ideal positioning of the free weights prior to and following a usage session (workout).

15 Claims, 11 Drawing Sheets

(58) Field of Classification Search
CPC . A63B 23/1227; A63B 21/0616; A63B 21/16; A63B 1/00; A63B 21/4031; A63B 21/00047; A63B 21/0617; A63B 21/08
See application file for complete search history.

(56) References Cited

U.S. PATENT DOCUMENTS

| | | | | |
|---|---|---|---|---|
| 7,699,756 | B2 * | 4/2010 | Piane, Jr. | A63B 1/00 248/222.52 |
| 9,492,701 | B1 * | 11/2016 | Bognatz | A63B 21/072 |
| 10,850,153 | B1 * | 12/2020 | Sorin | A63B 21/0783 |
| 2007/0049472 | A1 * | 3/2007 | Hummer, Jr. | A63B 71/0036 482/104 |
| 2014/0087928 | A1 * | 3/2014 | Luedeka | A63B 21/4023 482/130 |
| 2016/0263461 | A1 * | 9/2016 | Kay | A63B 21/153 |
| 2018/0326250 | A1 * | 11/2018 | Henniger | A63B 23/0405 |
| 2020/0346063 | A1 * | 11/2020 | Shaw, Jr. | A63B 71/0054 |
| 2020/0384337 | A1 * | 12/2020 | Brasch | A63B 23/1218 |
| 2021/0170218 | A1 * | 6/2021 | Lewis-Dove | A63B 17/04 |
| 2022/0062687 | A1 * | 3/2022 | Gao | A63B 21/0783 |
| 2022/0323815 | A1 * | 10/2022 | Simental | A63B 21/0557 |

* cited by examiner

FREE WEIGHT HARNESS SYSTEM

RELATED APPLICATIONS

This patent application claims the benefit under 35 U.S.C. § 119(e) of U.S. Provisional Patent App. No. 63/162,813, filed Mar. 18, 2021, entitled "FREE WEIGHT HARNESS SYSTEM," incorporated herein by reference in entirety.

BACKGROUND

Free weights such as dumbbells and barbells provide a simple and inexpensive device for resistance based exercise. A rigid bar with weights at either end provides a reliable piece of equipment and an absence of moving parts that can impose maintenance and safety concerns. Resistance is provided by gravitational force on the weights, and in some designs is variable by adding additional weights, or plates. Others provide a unitary molded design and often take the form of multiple dumbbells in a series of increasing mass.

SUMMARY

A support assembly and exercise system provides safe and unconstrained movement of free weights within a movement zone encompassing normal travel of the free weights during exercise. The system allows safe user engagement and disengagement with the free weights while continually tethered against uncontrolled and possibly harmful movement. The support assembly is defined by a generally free-standing frame with rigid uprights for supporting takeoff and landing zones for the free weights, as well as tether attachments for movably supporting the free weights through the movement zone. A support member has a pivotal attachment to the upright frame for suspending the free weights against an uncontrolled release or fall. Launch and landing platforms attach to the upright frame for ideal positioning of the free weights prior to and following a usage session (workout).

Configurations herein are based, in part, on the observation that conventional approaches to conditioning and recreational weight training often employ free weights of substantial mass used for strength training simply by manual lifting against a natural gravitational resistance. While free weights offer a simple and direct resistance to muscular effort, they suffer from the shortcoming that they can cause injury if improperly handled or dropped. Accordingly, configurations herein substantially overcome the shortcomings of conventional free weight usage devices by providing an upright frame and selectively engageable tethers to free weights that allow lifting freedom around a movement zone yet support the free weight via the tethers secured to the upright frame in the event of uncontrolled release or movement.

A particular configuration provides a usage and support apparatus for recreational movement of a free weight or weights, including an upright frame defining an exercise region, and an overhead support member attached to the upright frame and extending horizontally over the exercise region. A pivotal attachment between the support member and the upright frame disposes the support member above the exercise region for selective engagement with a tethered attachment to a free weight, where the pivotal attachment has a cantilever or torque limiting engagement with the upright frame for supporting the free weight counter to a gravitational force. The support member attaches to the upright frame and extends horizontally over the exercise region for defining a movement zone of tethered attachment of the free weights. One or more horizontal surfaces attach between opposed pairs of the plurality of upright members provides a take-off and/or landing surface within the movement region defined by a length of the tethers.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

The description below presents an example of the upright frame and safety tethers in conjunction with free weights for preventing a free fall of a dropped or mishandled weight, typically a dumbbell. The restraint mechanism is applicable to a variety of configurations of resistance objects including weights and other potential or stored energy exercise members, such as elastic strands and spring or coil loaded approaches that invite physical exertion against a stored force.

Figure 1:
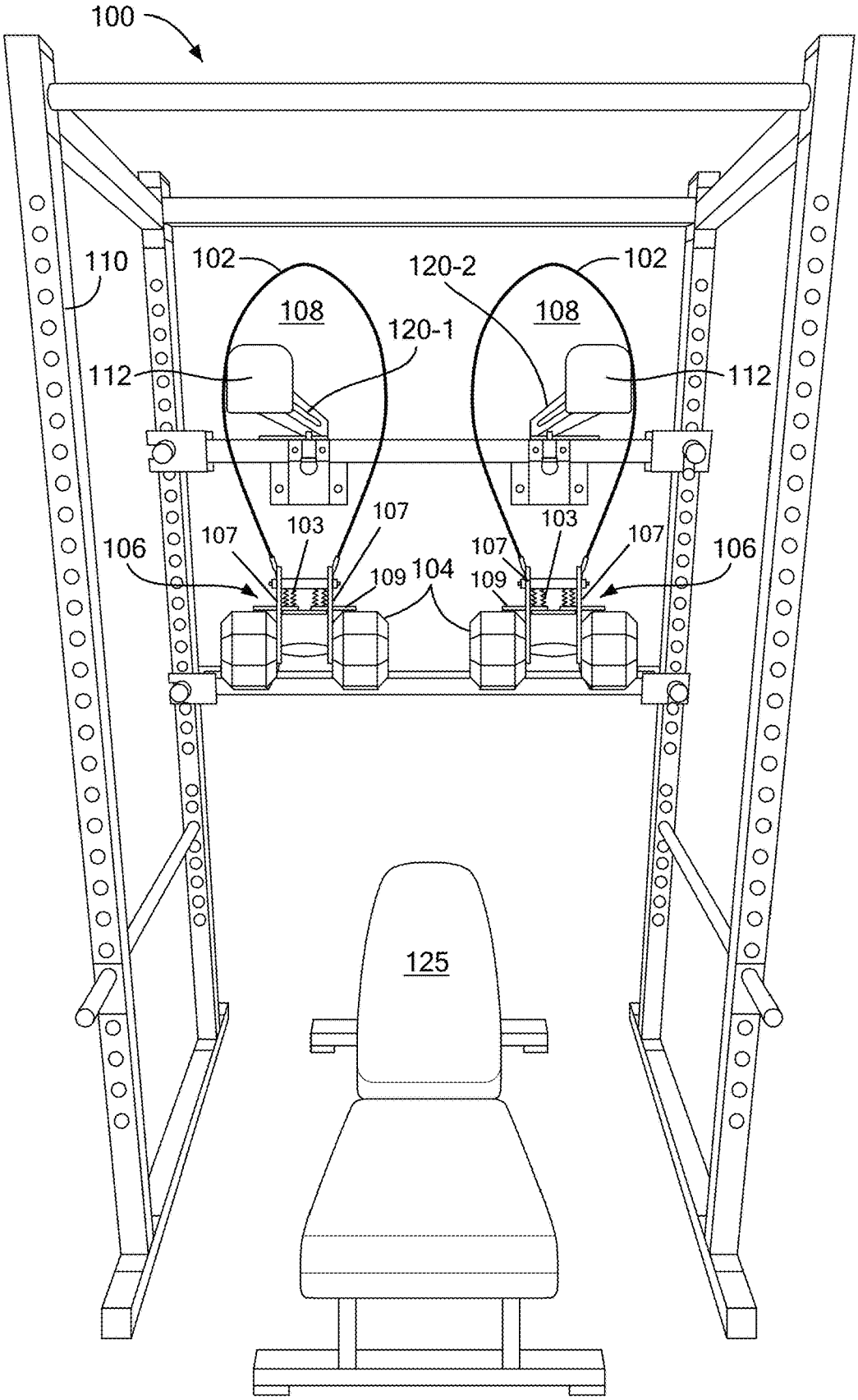
FIG. 1 is a front perspective view on an exercise environment and apparatus suitable for use with configurations herein.

FIG. 1 is a front perspective view on an exercise environment and apparatus suitable for use with configurations herein. Referring to FIG. 1, a tethered attachment defines a non-restrictive region around a movement zone of a normal exercise and workout routine, and engages the free weight if dropped or uncontrollably disposed outside the movement zone. The tethers engage the weights through a releasable engagement such as that disclosed in copending application Ser. No. 17/460,621, filed Aug. 30, 2021, entitled "EXERCISE WEIGHT SAFETY HARNESS AND CLAMP," incorporated herein by reference in entirety.

In particular configurations, the system includes a free weight support and restraint safety apparatus 100, including a tether 102 engaged with an upright frame 110 for securing a free weight 104 against unintended release and droppage, and an attachment 106 for securing the tether to the free weight 104. The attachment 106 includes a pair of opposed clips 107, and a spring loaded actuator 103 securing a restraint 109. A pivoting support member 120 (support member) is adapted for lateral movement in a movement zone, in which the movement zone is defined by a volume of controlled manipulation of the free weight for intended use. A linkage between the tether and the pivoting support member is adapted to pivotally dispose the tethered free weight proximally and distally around the movement zone for user engagement and disengagement with the free weight 104.

The pivoting tether allows ingress and egress to the movement zone by the user, and is adapted to bear the mass of the free weight 104 through the pivoting range. Typically it takes the form of a pair of longitudinal bars extending from a rotational bearing on one end, with a protrusion or hook on the other. The tethers 102 drape over the longitudinal bar and are secured by the protrusion or hook. The longitudinal bars (support members) are therefore allowed to pivot outward as needed to accommodate user movement, and pivot inward until substantially parallel and aligned with the user. A bench or seat 125 accommodates the user during lifting.

The linkage of the free weights therefore includes a tethered loop 108 around the pivoting support member 120 and the protrusion 112 at an end of the pivoting support member. Under tension, the tethers 102 may slide axially along the support members and as permitted by the pivotal outward motion, providing a large movement zone while still tethered in the event of droppage, while the protrusion 112 prevents the tethers from sliding off the end of the pivoting support member 120.

Figure 2A:
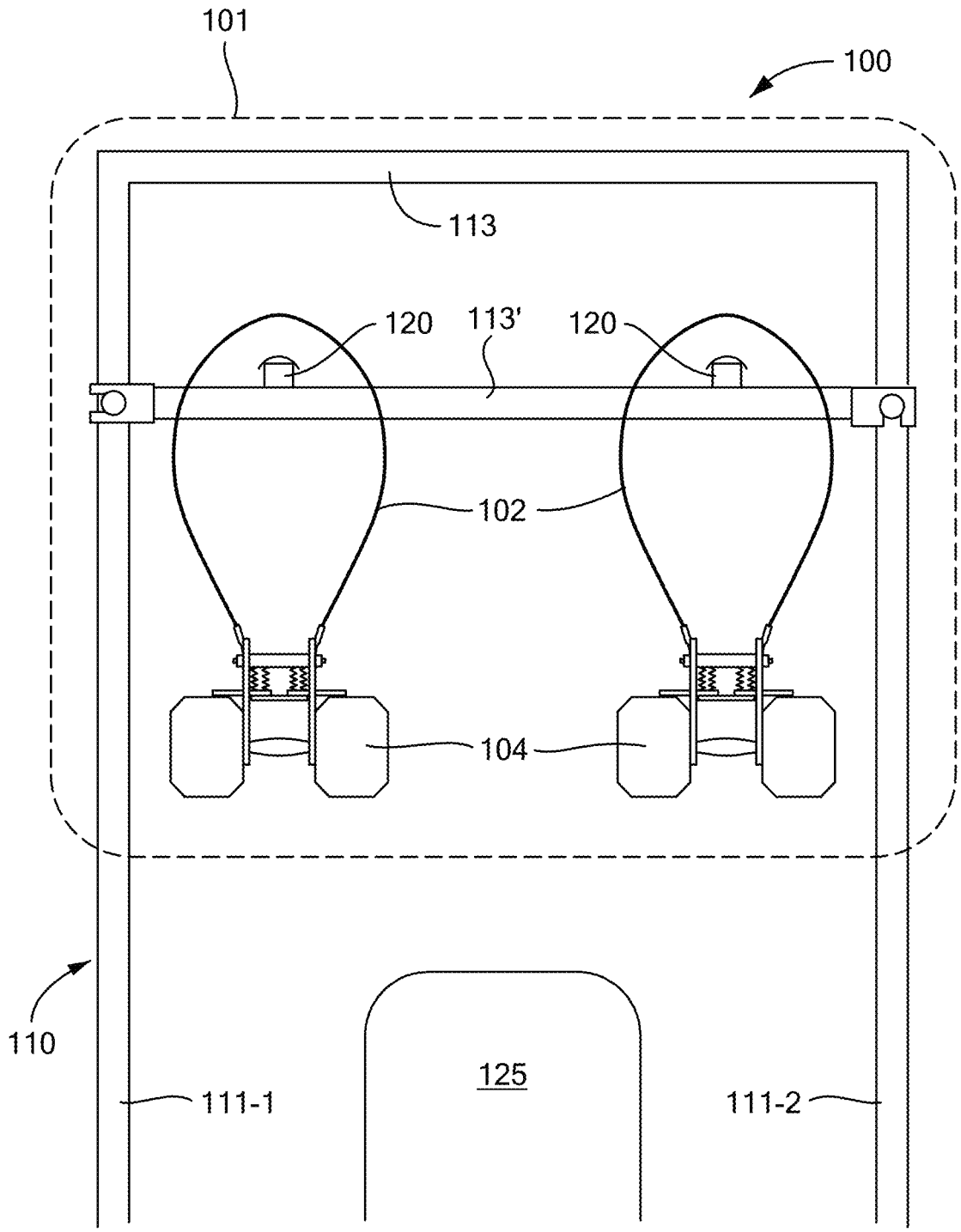
FIGS. 2A-2C are schematic views of a front elevation, plan and side elevation views, respectively, of the apparatus of FIG. 1.
Figure 2B:
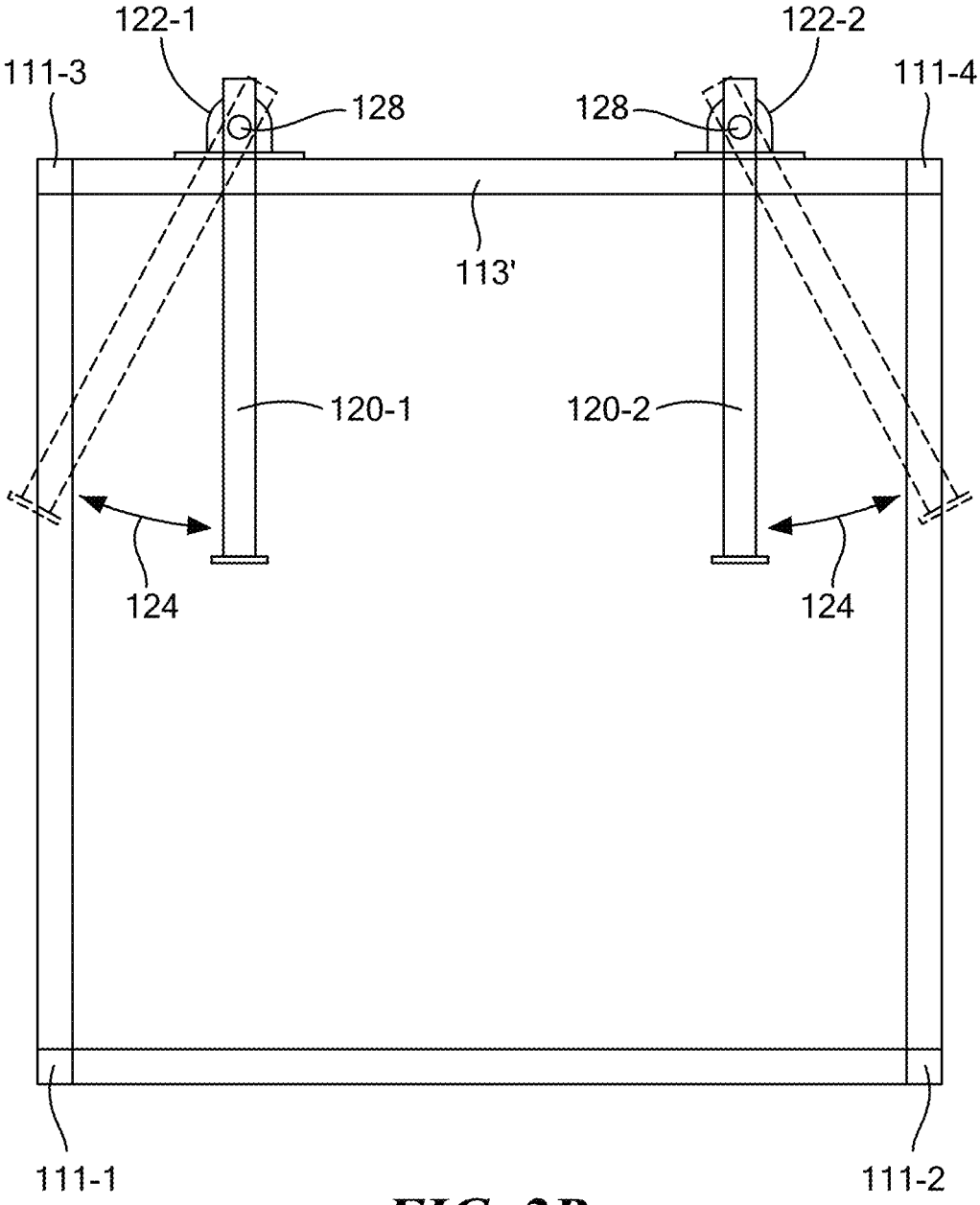
Figure 2C:
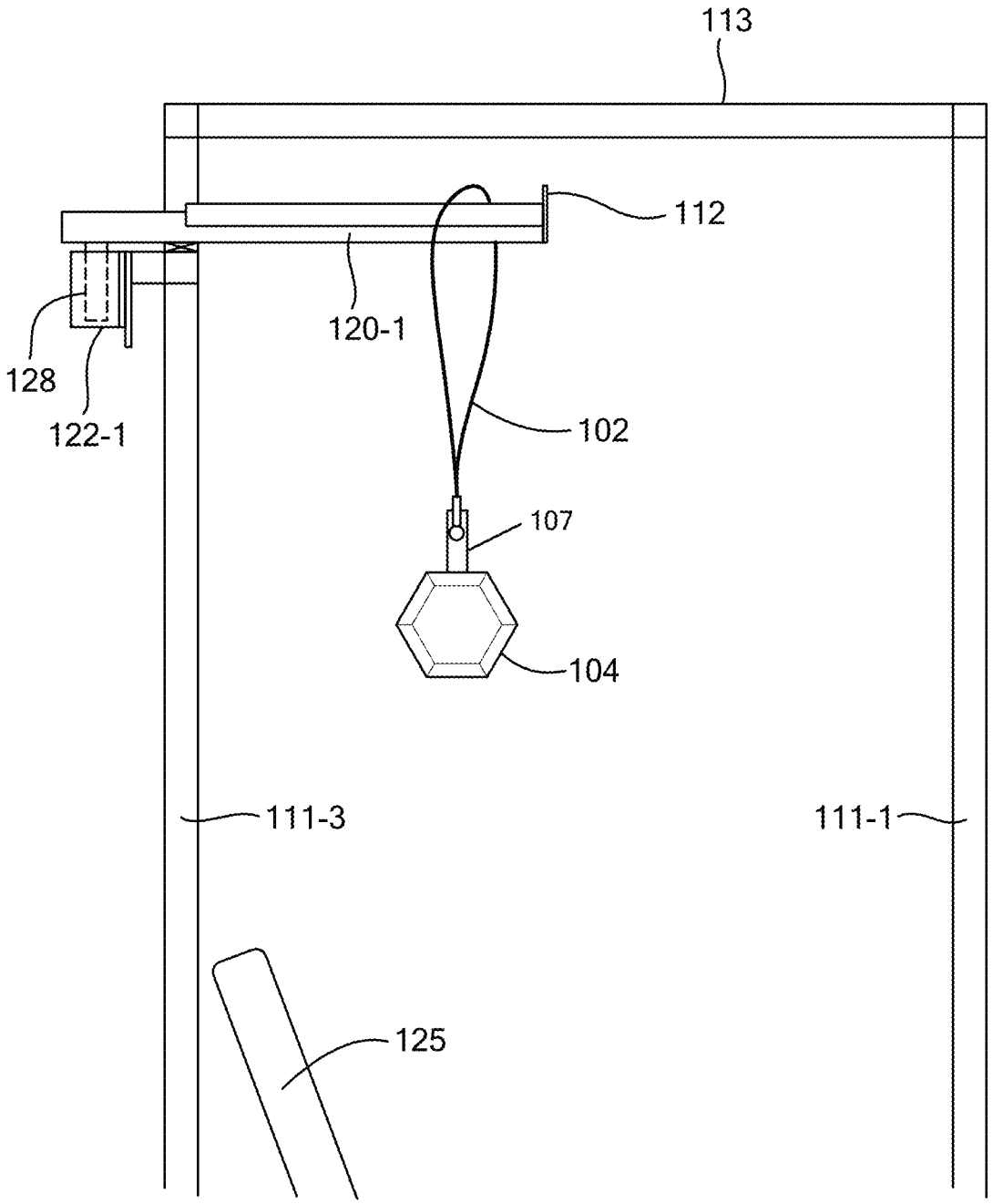

FIGS. 2A-2C are schematic views of a front elevation, plan and side elevation views, respectively, of the apparatus of FIG. 1. In the free weight harness system 100, a plurality of upright members 111-1 . . . 111-4 (111 generally) define the upright frame 110, such that the upright members are disposed vertically for supporting at least one of the pivoting support members 120. Typically, for a free standing approach, four upright members 111 define a full frame, and the two pivoting support members 120-1 . . . 120-2 (120 generally) attach to a horizontal bar, crossmember 113' or support across two of the upright members 111.

The upright members 111 are rigid metal load-bearing structures, and join with horizontal crossmembers 113 where needed for stability, such as a launch platform 150, side platform (discussed below), and horizontal support 113' for the pivoting support members 120. Other suitable frames may be envisioned the pivotal attachments 122-1 . . . 122-2 (122 generally) define a movement zone 101 based on a sweeping arc 124 of the support member in a plane perpendicular to the uprights and based on a length of the tethered attachment in a region below the sweeping arc. In other words, the free weights 104 may be manipulated within the range or radius of the tether 102, and further by pivoting the support members 120 outwards. Generally, the support members are intended to be fixed in a parallel position during use, and pivot outwards to allow free weight placement on a side tray.

Figure 3:
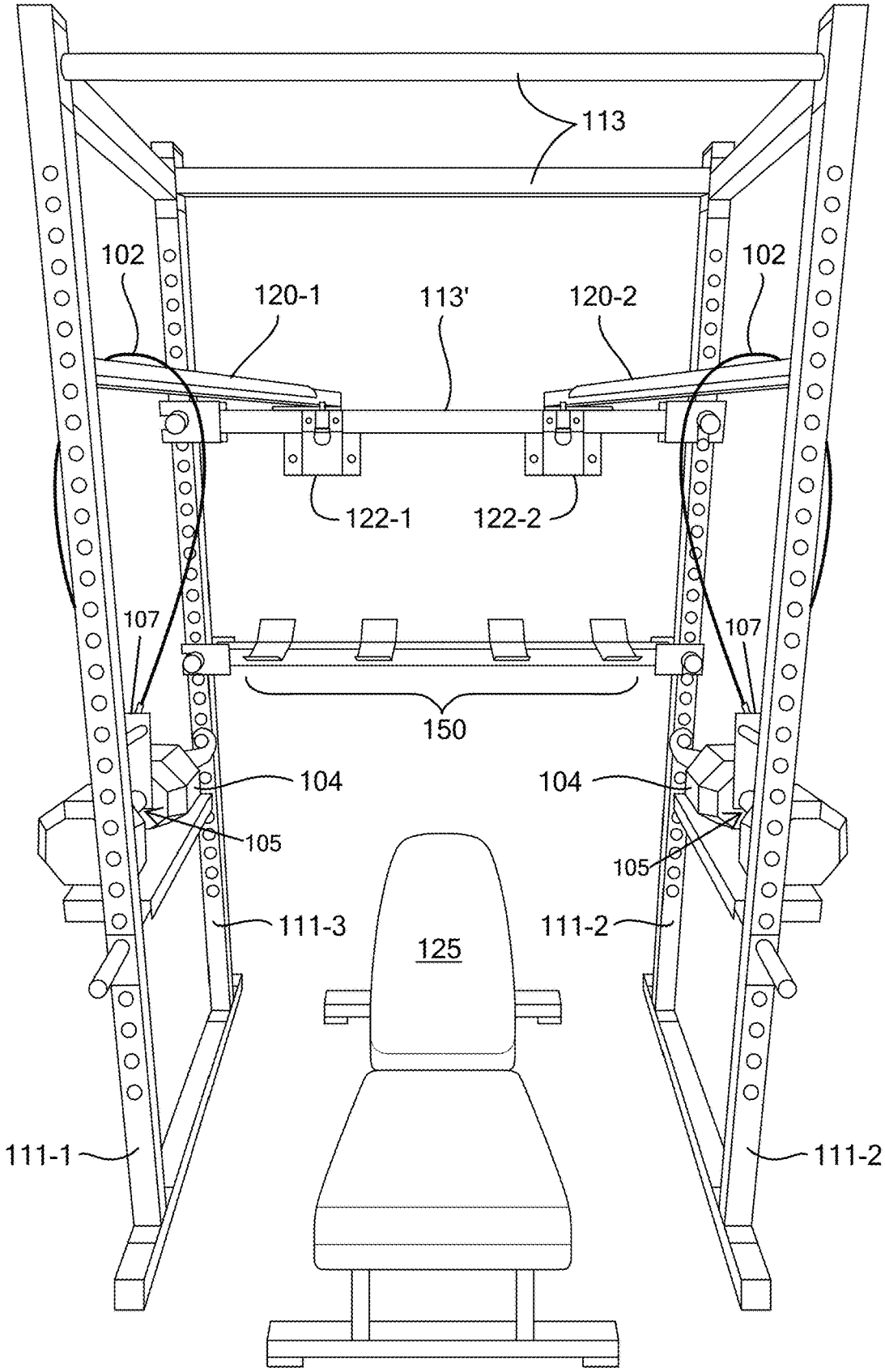
FIG. 3 is a front perspective view with the support members pivoted outwards as in FIG. 2B.

FIG. 3 is a front perspective view with the support members pivoted outwards as in FIG. 2B. Referring to FIGS. 1-3, a typical exercise routine commences with weights in a launch position, where the user may proceed directly to resistance movement with the weights, and ends with a landing zone, ideally near the end of a cyclic pattern so that a possibly exhausted arm need not further manipulate the free weight very far. Accordingly, the frame 110 includes a launch platform 150 removably engaging the upright members. The launch platform is engaged in an interference fit with horizontal protrusions such as pegs extending from the engaged upright members, and is adapted to support the free weight in an accessible position. A typical launch platform 150 is disposed in front of the user just below the pivoting support members 120 so that the tethers 102 loop around the support members 120 with ample slack for movement within the movement zone 101. A particular feature includes a facilitated mounting for the launch platform. In operation, a user need only slide one end of the crossmember 113 into a horizontal recess, as with the support members crossbar 113' and then allow the other end drop onto the opposing protrusions (on the opposing upright 111) via the vertical recess.

A landing zone is provided by a side platform 140 adapted to engage the frame 110, and is disposed for receiving and bearing the free weight within range of the tether. The side platform is defined by a longitudinal surface adapted to extend between opposed upright members of the frame, in which the longitudinal surface has a detachable engagement with a respective upright member at each opposed end. In a particular configuration, the landing zone extends along a side perpendicular to the horizontal support for the pivots and parallel to the ground for floor, thus disposed on right and left sides between front and rear uprights in a frame with four uprights.

In a particular configuration, the tethers 102 engage the free weights as disclosed in the copending application cited above. Therefore, the attachment for securing the tether to the free weight further includes the opposed clips 107 adapted for attachment to a handle of a free weight, such that the clips have a spacing for engaging the handle at locations flanking a grip region of the handle. A receptacle 105 on each of the clips 107 receives the handle of the free weight, the tether attaches to the opposed clips, and the restraint 109 secures the clip to the handle, such that the restraint has a spring loaded actuator 103 for biasing the restraint in a secured position. This complements the support members by ensuring that the free weight 104 cannot disengage from the tether 102.

Figure 4:
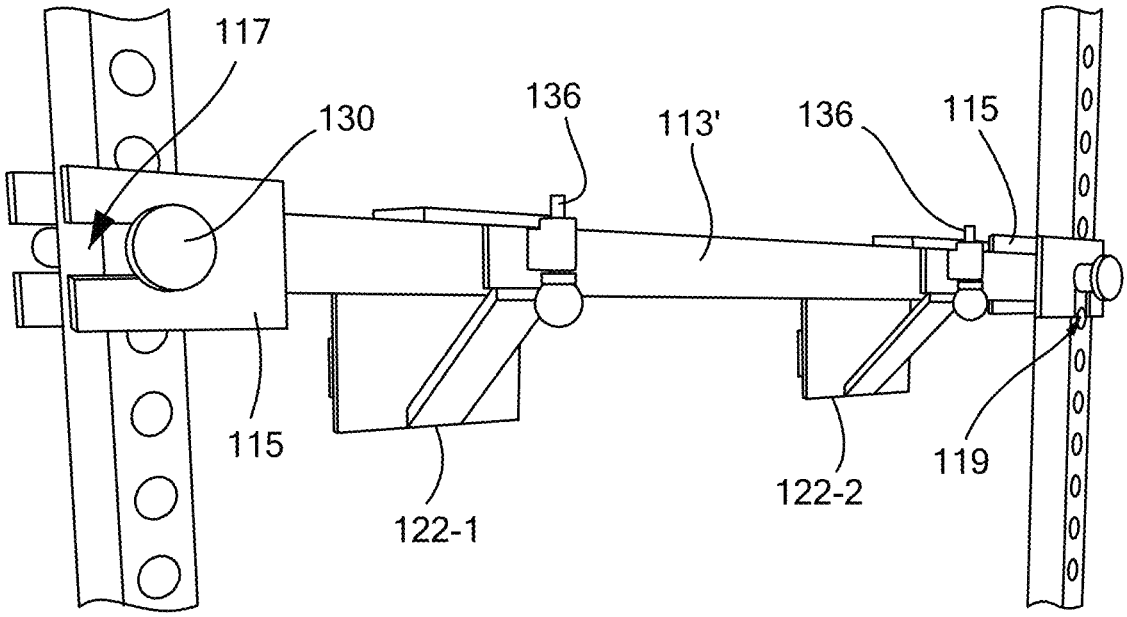
FIG. 4 is a perspective view of crossmember for the pivotal attachment as shown in FIGS. 1-3.

FIG. 4 is a perspective view of crossmember for the pivotal attachment as shown in FIGS. 1-3. Referring to FIGS. 1-4, the support members 120 extend from a crossmember 113' having opposed ends 115 including a receptacle having a horizontal opening 117 and a receptacle having a vertical opening 119 for engagement with protrusions 130 on the respective upright members 111.

Figure 5:
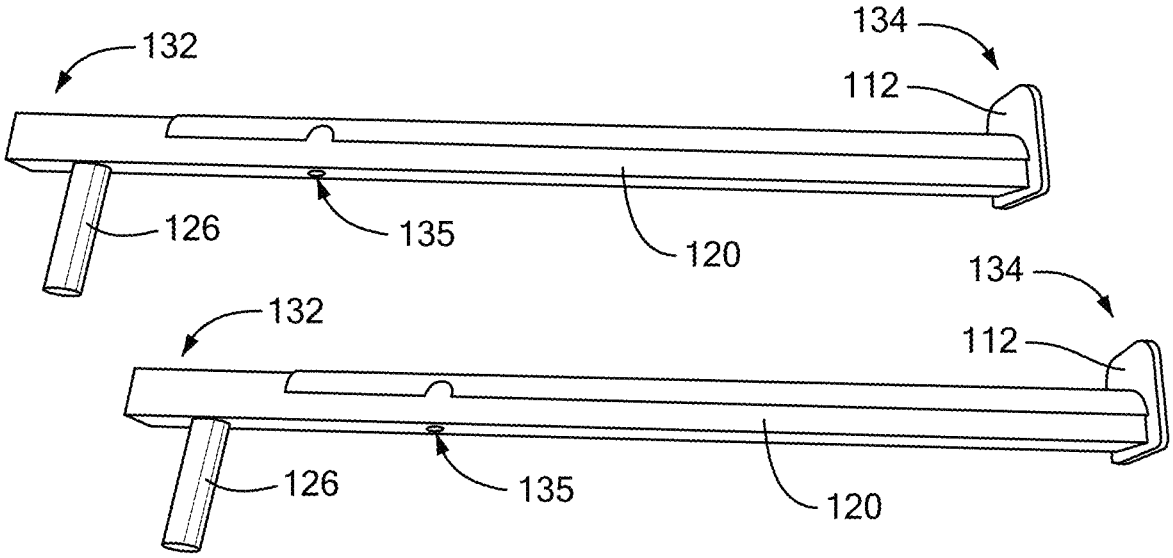
FIG. 5 shows the support members adapted to engage the crossmember of FIG. 4 to form the pivotal attachment.

FIG. 5 shows the support members 120 adapted to engage the crossmember 113' of FIG. 4 to form the pivotal attachment 122. Each pivotal attachment has a receptacle 128 for receiving a shaft 126 at a proximate end 132 of the support member 120. The pivotal attachment also has a spring-loaded locking pin 136 for engaging a locking aperture 135 on the respective support member 120. When locked, the support members are parallel for use with tethered free weights. The pivotal attachment 122 with the shaft 126 fulling inserted is sufficiently rigid to avoid force or rotation imposed by a dropped free weight. The protrusions 112 on the distal end 134 retain the tethers 102 from sliding off the distal end 134.

Figure 6:
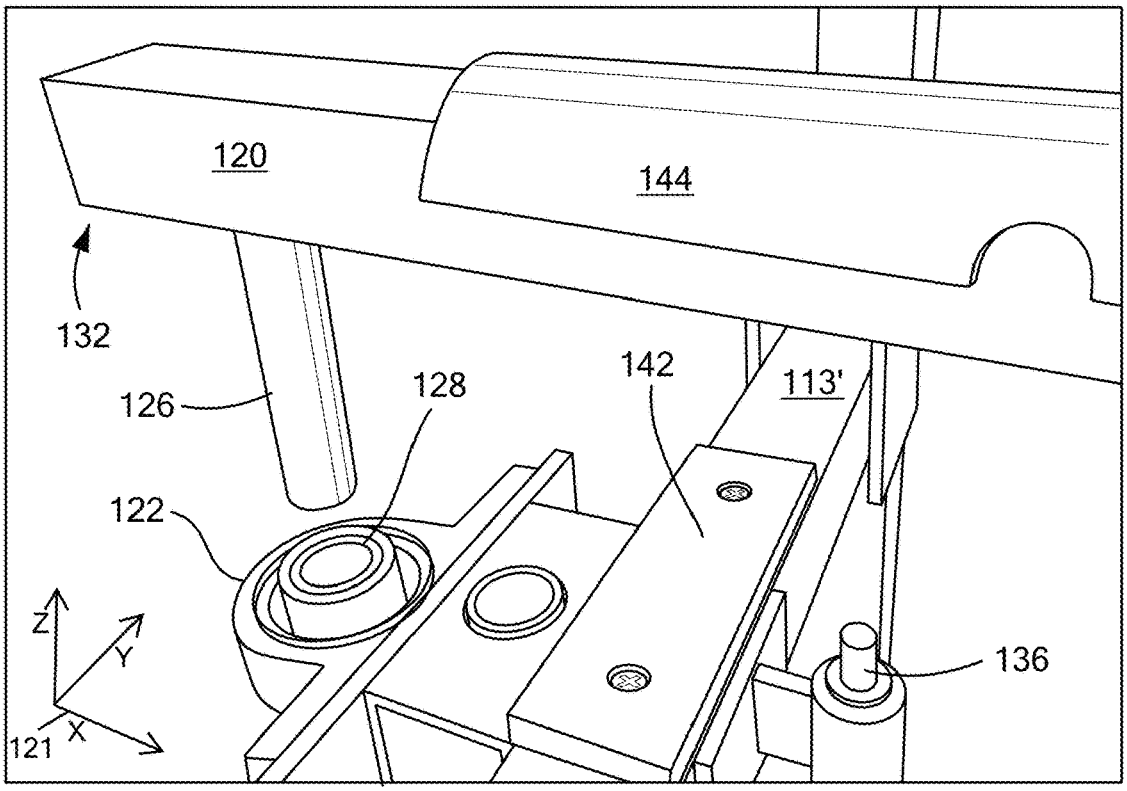
FIG. 6 shows the pivotal attachment of FIGS. 4 and 5.

FIG. 6 shows the pivotal attachment of FIGS. 4 and 5. Referring to FIGS. 1-5, the pivotal attachment further includes the vertical shaft 126 at the proximate end 132 of the support member 120, and the receptacle 128 on the crossmember 113' attaches to the upright frame for receiving the vertical shaft 126. An intermediate support 142 engages the support member 120 along a longitudinal side just before the locking aperture 135 for accommodating downward forces from the tethered attachment imposed towards the distal end 134 of the support member, as in the case of a dropped free weight. The intermediate support 142 provides a bearing surface from absorbing the load from the dropped free weight. This provides for a torque limiting engagement from an interference fit with the intermediate support. Otherwise, the entire force of a dropped weight would tend to impose a forward, leveraged rotation on the receptacle 128. The transverse orientation of the intermediate support addresses pivotal movement in a plane x, y parallel to the movement and perpendicular to an axis z of the pivot, shown in orientation 121, meaning even if the support members are swung out as in FIG. 2B, the support member 120 still bears on the intermediate support 142.

A dropped free weight (or even a gently hanging free weight) imposes the corresponding mass on the support member 120 and tether 102. Accordingly, the support member has an annular outer surface 144 from a radiused cover. The curvature spreads any point load that could affect the tether 102 if it had a sharp or square corner.

Figure 7:
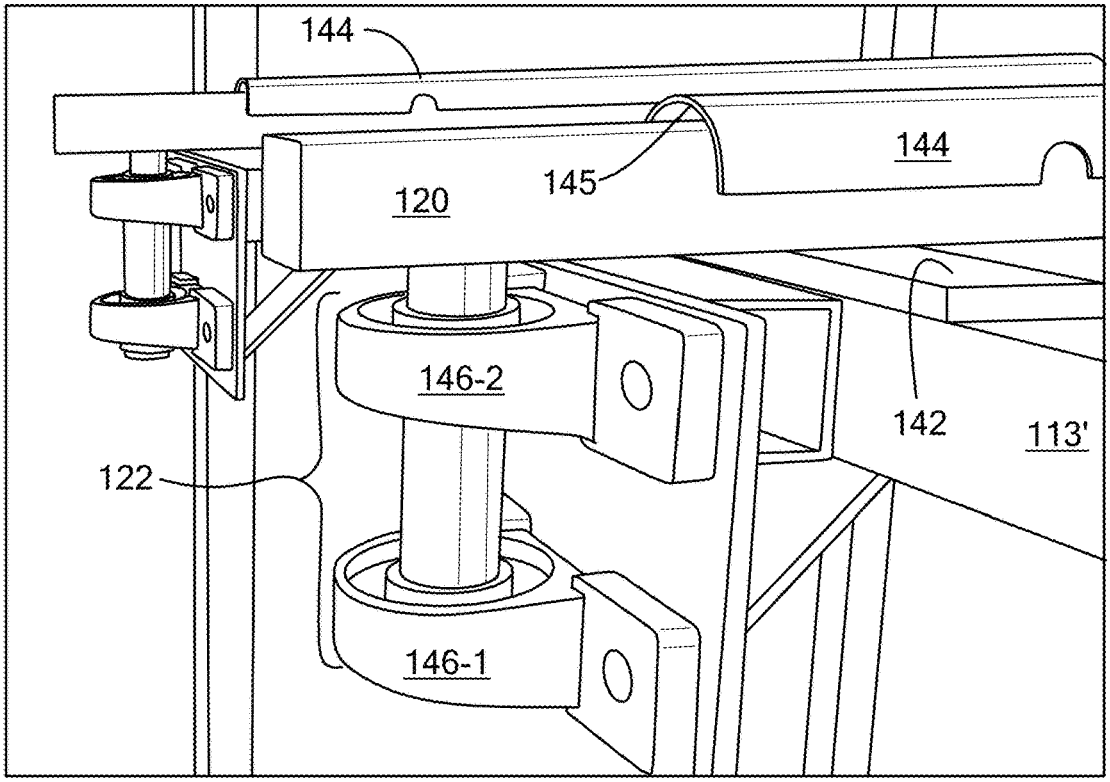
FIG. 7 shows a receptacle of the pivotal attachment of FIG. 6.

FIG. 7 shows a receptacle of the pivotal attachment of FIG. 6. The side elevation of FIG. 7 shows that the receptacle 128 is defined by two axially aligned bearings 146-1 . . . 146-2 bolted onto a vertical plate attached to the crossmember 113'. The annular outer surface 144 of the radiused element 145 can be seen disposed on an upper side of the support member 120.

Figure 8:
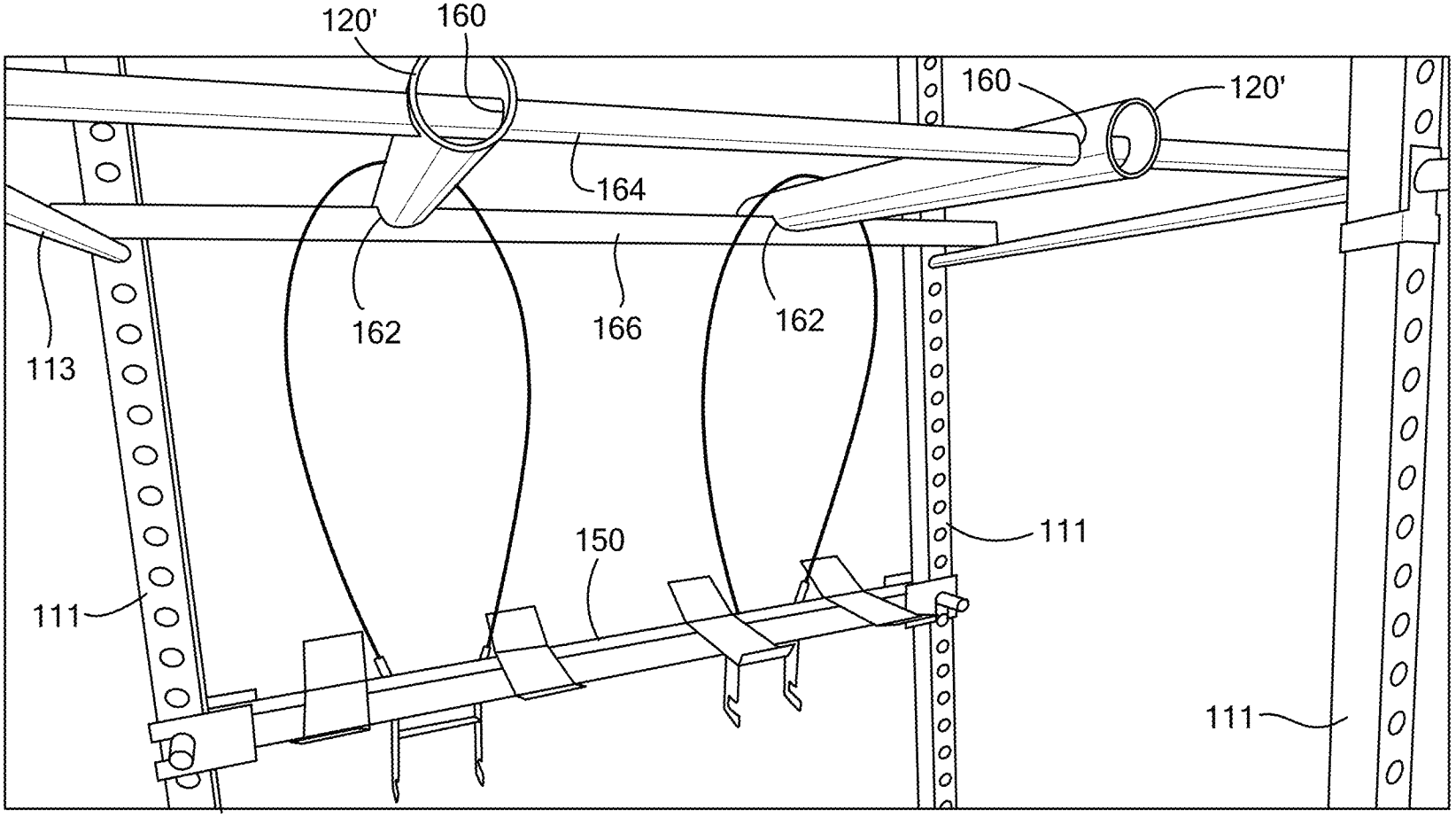
FIG. 8 shows an alternate configuration of the support members using a hinge.

FIG. 8 shows an alternate configuration of the support members using a hinge. In the configuration of FIG. 8, the support members attach to the upright frame and extending horizontally over the exercise region using a hinge between the support member and the upright frame. The hinge is defined by a through hole 160 in the support member allowing pivotal communication with a hinge bar 164. A landing bar 166 at an opposed end of the support members 120' has a slot 162 receiving the support member 120' to define a closed position. Alternatively, the slot could be in the support member 120' to engage the landing bar 166. The hinge has an open position and a closed position for disposing the support member in selective engagement with a tethered attachment to the free weight 104. The closed position engages the support member 120' with the perpendicular crossmember or landing bar 166 for securing the tethered attachment, and the open position releases the tethered attachment be lifting the support member off the landing bar 166 and allowing the tether 102 to slide out. As with the pivot arm configuration of the support arm 120, the tethered attachment is a tethered loop attached to the free weight, such that the support member has a terminal (open) end when the hinge is in the open position and secures the tethered loop in an interference fit when the hinge is in the closed position.

Figure 9:
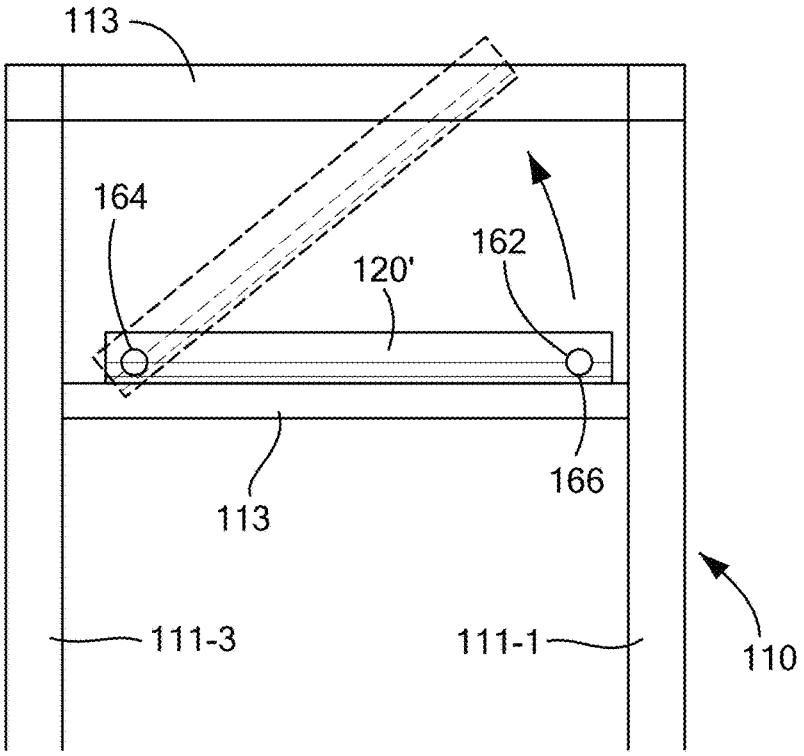
FIG. 9 shows a schematic diagram of the hinge of FIG. 8.

FIG. 9 shows a schematic diagram of the hinge opening of FIG. 8. Referring to FIGS. 8 and 9, the landing bar 166 has a receptacle 162 adapted to receive and engage the support member 120' as the hinge transitions from the open position to the closed position. The closed position supports a gravitational force of the free weight on both the hinge 164 and the crossmember via the tethered attachment.

Figure 10:
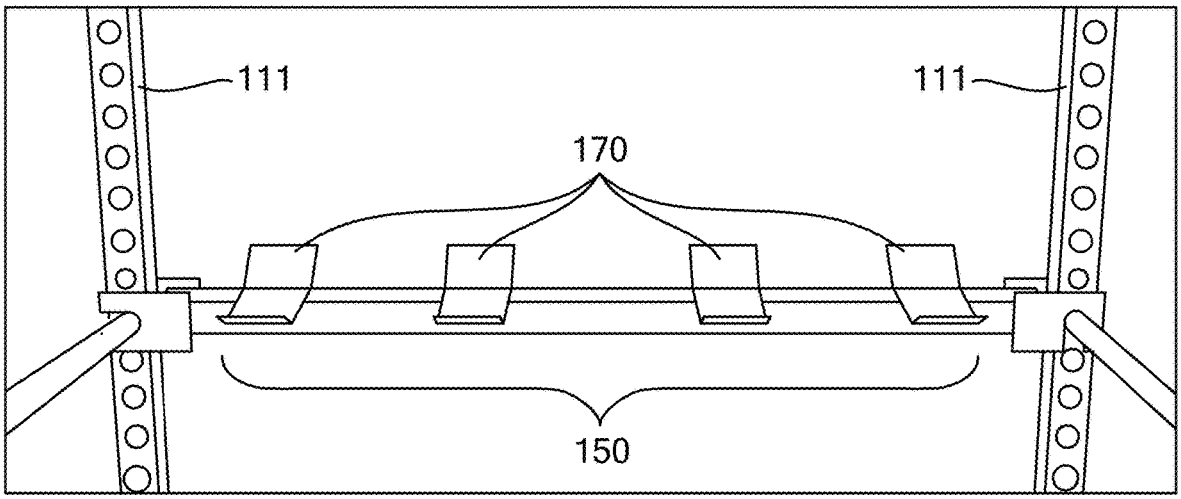
FIG. 10 shows a crossmember in the upright frame of FIGS. 1-3 including a launch platform.

FIG. 10 shows a crossmember in the upright frame of FIGS. 1-3 including a launch platform. The launch platform 150 is defined by one or more horizontal surfaces 170 attached between an opposed pair of the plurality of upright members 111, such that the horizontal surface 170 is within a movement region defined by a length of the tethers 102 and adapted for receiving the free weight 104. In a particular configuration, the horizontal surfaces 170 align with the distance of the opposed elements of the free weight 104. In operation, the launch platform 150 disposes the free weights 104 for commencement of an exercise routine.

Figure 11:
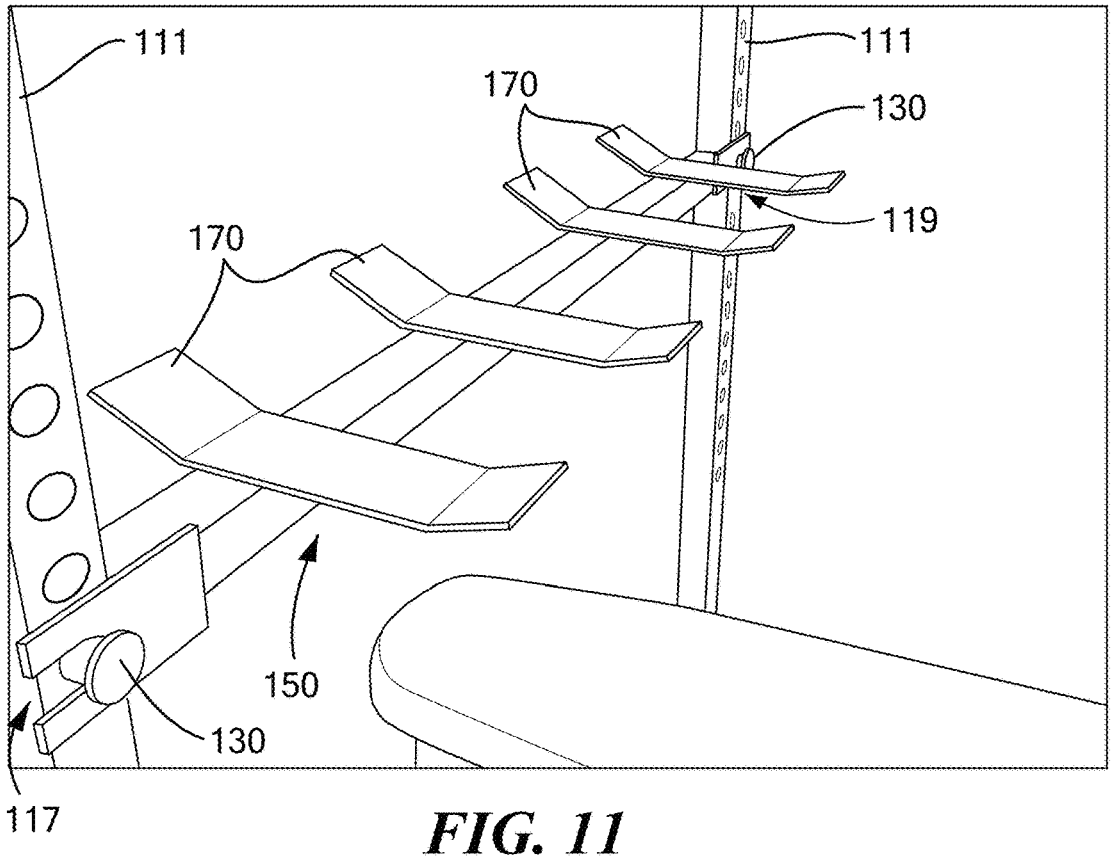
FIG. 11 shows a perspective view of the launch platform of FIG. 10.

FIG. 11 shows a perspective view of the launch platform of FIG. 10. The launch platform 150 attaches via a crossmember 113 similar to the pivot supports 122. Alternate configurations may alter the size and/or spacing of the horizontal surfaces 170.

Figure 12:
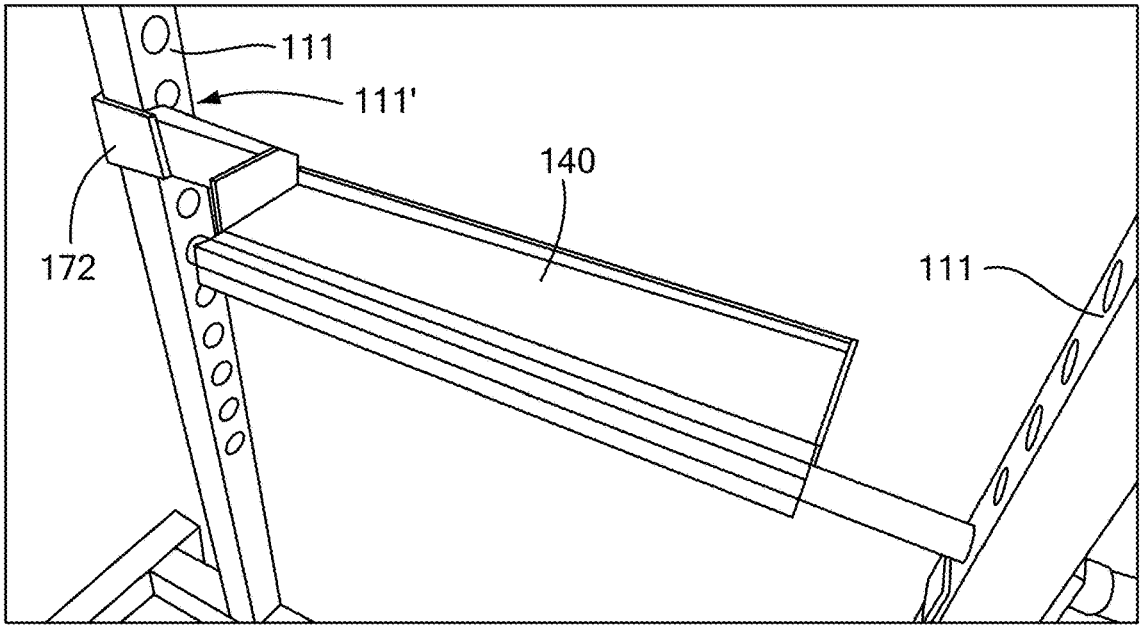
FIG. 12 shows a side platform engaging the upright frame of FIGS. 1-3.

FIG. 12 shows a side platform 140 engaging the upright frame of FIGS. 1-3. In a particular configuration, the side platform further comprises a wrap around attachment 172 extending from one end of the opposed ends for defining an interference fit with a surface of the respective upright 111. The wrap around forms at least a 90 degree bend for a square upright, or a semicircular shape for a circular upright, and need only contact the exterior surface 111' surface without any need for a cross pin or protrusion 130. A lateral bar 174 supports the length of the side platform between two uprights 111.

Figure 13:
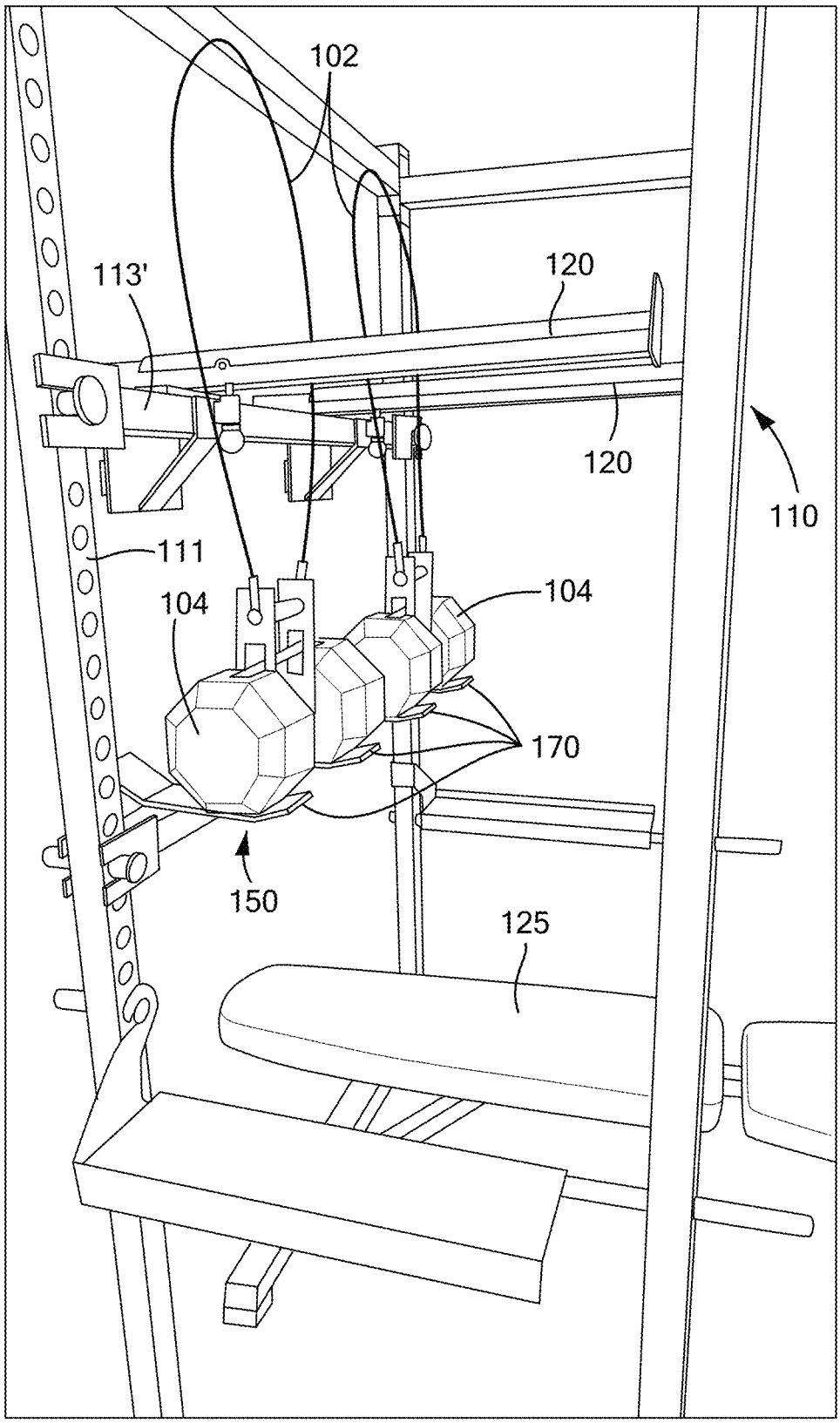
FIG. 13 shows a side perspective view of the upright frame with the pivotal attachment of FIGS. 4-7, the launch platform of FIGS. 10-11 and the side platform of FIG. 12.

FIG. 13 shows a side perspective view of the upright frame with the pivotal attachment of FIGS. 4-7, the launch platform of FIGS. 10-11 and the side platform of FIG. 12.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A usage and support apparatus for recreational movement of a free weight, comprising:

an upright frame defining an exercise region;

a support member cantilevered from a crossmember on the upright frame and extending horizontally over the exercise region; and a pivotal attachment between the support member and the upright frame, the pivotal attachment disposing the support member for pivotal movement in a horizontal plane above the exercise region for selective engagement with a tethered attachment to a free weight for movement based on a predetermined length of the tethered attachment, the tethered attachment extending from the support member, the tethered attachment further comprising a linkage including a tethered loop around the support member and a protrusion at a distal end of the support member for user engagement and disengagement with the free weight;

the pivotal attachment having a torque limiting engagement with the crossmember for supporting the free weight counter to a gravitational force.

2. The usage and support apparatus of claim 1 wherein the tethered attachment defines a movement zone based on a length of the tethered attachment, the tethered attachment extending from the support member.

3. The usage and support apparatus of claim 1 wherein the tethered attachment for securing the free weight further comprises:

a plurality of opposed clips adapted for attachment to a respective handle of the free weight, the plurality of opposed clips having a spacing for engaging the handle at locations flanking a grip region of the handle;

a receptacle on each of the plurality of opposed clips for receiving the handle;

a tether attached to each of the plurality of opposed clips; and a restraint for securing each of the plurality of opposed clips to the handle, the restraint having a spring loaded actuator for biasing the restraint in a secured position.

4. The usage and support apparatus of claim 1 wherein the torque limiting engagement defines pivotal movement in a plane perpendicular to an axis of the pivotal movement.

5. The usage and support apparatus of claim 1 wherein the pivotal attachment further comprises:

a vertical shaft at a proximate end of the support member;

a receptacle on a crossmember attached to the upright frame for receiving the vertical shaft; and an intermediate support engaging the support member along a longitudinal side for accommodating downward forces from the tethered attachment imposed towards a distal end of the support member.

6. The usage and support apparatus of claim 5 further comprising a biased locking pin on the intermediate support adapted to engage the support member to prevent pivotal movement.

7. The device of claim 1 wherein the upright frame further comprises a plurality of upright members, the crossmember attached to one or more of the plurality of upright members.

8. The usage and support apparatus of claim 7 wherein the pivotal attachment defines a movement zone based on a sweeping arc of the support member in a plane perpendicular to the plurality of upright members and based on a length of the tethered attachment in a region below the sweeping arc.

9. A usage and support apparatus for recreational movement of a free weight, comprising:

an upright frame defining an exercise region;

a support member cantilevered from a crossmember on the upright frame and extending horizontally over the exercise region:

a pivotal attachment between the support member and the upright frame, the pivotal attachment disposing the support member for pivotal movement in a horizontal plane above the exercise region for selective engagement with a tethered attachment to a free weight for movement based on a predetermined length of the tethered attachment, the tethered attachment extending from the support member;

a plurality of upright members defining the upright frame, each upright member of the plurality of upright members disposed vertically for supporting the support member and the pivotal attachment;

wherein the support member extends from the crossmember, the crossmember having opposed ends including a receptacle having a horizontal slot opening on one of the opposed ends and a receptacle having a vertical slot opening on the other of the opposed ends for engagement with protrusions on a respective upright member of the plurality of upright members, the pivotal attachment having a torque limiting engagement with the crossmember for supporting the free weight counter to a gravitational force.

10. The usage and support apparatus of claim 9 further comprising a launch platform removably engaging the plurality of upright members, the launch platform engaged in an interference fit with horizontal protrusions extending from the plurality of upright members, the launch platform configured to support the free weight.

11. The usage and support apparatus of claim 9 further comprising a side platform adapted to engage the upright frame and disposed for receiving and bearing the free weight within a range of the tethered attachment, the side platform defined by a longitudinal surface and opposed ends adapted to extend between the plurality of the upright members of the upright frame, the longitudinal surface having a detachable engagement with a respective upright member of the plurality of upright members at each opposed end.

12. The usage and support apparatus of claim 11 wherein the side platform further comprises a wrap around attachment, the wrap around attachment extending from one end of the opposed ends for engaging the respective upright member, the other opposed end engaged with a respective upright member for vertical support.

13. A usage and support apparatus for recreational movement of a free weight, comprising:

an upright frame defining an exercise region;

a support member attached to the upright frame and extending horizontally over the exercise region; and a hinge between the support member and the upright frame, the hinge having an open position and a closed position for disposing the support member in selective engagement with a tethered attachment to a free weight, the closed position engaging the support member with a perpendicular crossmember for securing the tethered attachment around the support member, and the open position releasing the tethered attachment, the perpendicular crossmember having a receptacle adapted to receive and engage the support member as the hinge transitions from the open position to the closed position, the closed position is configured to bear a gravitational force of the free weight on the perpendicular crossmember via the tethered attachment.

14. The usage and support apparatus of claim 13 wherein the support member has an annular outer surface and the tethered attachment is a tethered loop attached to the free weight, the support member having an open end when the hinge is in the open position.

15. The usage and support apparatus of claim 13 further comprising a plurality of support members in a parallel orientation.

* * * * *